US010207308B2

(12) United States Patent
Kowal

(10) Patent No.: US 10,207,308 B2
(45) Date of Patent: Feb. 19, 2019

(54) MANAGING PANEL-LIKE WORKPIECES AND PRODUCTS

(71) Applicant: TRUMPF Sachsen GmbH, Neukirch (DE)

(72) Inventor: Franz Kowal, Dresden (DE)

(73) Assignee: TRUMPF Sachsen GmbH, Neukirch (DE)

( * ) Notice: Subject to any disclaimer, the term of this patent is extended or adjusted under 35 U.S.C. 154(b) by 261 days.

(21) Appl. No.: 15/133,324

(22) Filed: Apr. 20, 2016

(65) Prior Publication Data

US 2016/0303638 A1 Oct. 20, 2016

(30) Foreign Application Priority Data

Apr. 20, 2015 (DE) ..... 10 2015 207 124

(51) Int. Cl.
*B21D 43/00* (2006.01)
*B21D 28/04* (2006.01)
(Continued)

(52) U.S. Cl.
CPC ..... *B21D 43/00* (2013.01); *B21D 28/04* (2013.01); *B21D 43/003* (2013.01);
(Continued)

(58) Field of Classification Search
CPC .... B21D 28/04; B21D 43/003; B21D 43/027; B21D 43/11; B21D 43/13; B21D 43/22;
(Continued)

(56) References Cited

U.S. PATENT DOCUMENTS 6,956,183 B2 10/2005 Erlenmaier
7,429,034 B2 9/2008 Erlenmaier
(Continued)

FOREIGN PATENT DOCUMENTS

CN 201783594 U 4/2011
CN 102066050 A 5/2011
(Continued)

OTHER PUBLICATIONS

Office Action in Chinese Application No. 201610239136.7, dated Aug. 27, 2018, 11 pages (with English translation).

*Primary Examiner* — Saul Rodriguez
*Assistant Examiner* — Brendan P Tighe
(74) *Attorney, Agent, or Firm* — Fish & Richardson P.C.

(57) ABSTRACT

A machine arrangement for processing panel-like workpieces includes a processing station for processing a workpiece to produce a processing product, a workpiece support for supporting the workpiece during the workpiece processing and the processing product after the workpiece processing, the workpiece support including an unloading-side support part and a further support part that are arranged laterally side-by-side and substantially flush with one another in a horizontal direction at their upper sides at a common level, a movement device to which the workpiece and the processing product can be attached in a detachable manner and by which the workpiece attached to the movement device and the processing product attached to the movement device can be moved over the workpiece support, and a handling device for unloading the processing product from the workpiece support.

16 Claims, 5 Drawing Sheets

(51) Int. Cl.
*B21D 43/02* (2006.01)
*B21D 43/11* (2006.01)
*B21D 43/18* (2006.01)

(52) U.S. Cl.
CPC ..... *B21D 43/027* (2013.01); *B21D 43/11* (2013.01); *B21D 43/18* (2013.01)

(58) Field of Classification Search
CPC ..... B21D 43/24; B23K 37/0408; B23Q 7/04; B23Q 7/103; B65H 5/04; B65H 5/10
USPC ..... 414/222.01, 225.01
See application file for complete search history.

(56) References Cited

U.S. PATENT DOCUMENTS

| | | | | |
|---|---|---|---|---|
| 9,682,414 | B2 | 6/2017 | Ichioka | |
| 2003/0147729 | A1* | 8/2003 | Leibinger | B65H 1/00 414/222.01 |

FOREIGN PATENT DOCUMENTS

| | | | |
|---|---|---|---|
| CN | 102159338 | A | 8/2011 |
| CN | 202984391 | U | 6/2013 |
| CN | 104245176 | A | 12/2014 |
| DE | 1139069 | B | 10/1962 |
| EP | 1 340 584 | A1 | 9/2003 |
| EP | 1340584 | A1 | 9/2003 |
| EP | 2177293 | A1 | 1/2013 |
| EP | 2839898 | A1 | 2/2015 |
| KR | 100825925 | B | 4/2008 |

* cited by examiner

MANAGING PANEL-LIKE WORKPIECES AND PRODUCTS

CROSS REFERENCE TO RELATED APPLICATION

This application claims priority under 35 U.S.C. § 119(a) to German Application No. 10 2015 207 124.3, filed on Apr. 20, 2015, the entire contents of which are hereby incorporated by reference.

TECHNICAL FIELD

The invention relates to processing panel-like workpieces, in particular metal sheets, and handling a processing product that has been produced from a panel-like workpiece.

BACKGROUND

U.S. 2003/014 7729 A1 discloses an example machine arrangement that includes a punching machine for the punch-processing of metal sheets and a loading and unloading device. A stationary punching station of the punching machine has an upper punching tool on an upper frame leg of the punching machine and a lower punching tool disposed opposite to the upper punching tool on a lower frame leg of the punching machine. A support part of a horizontal workpiece support of the punching machine extends respectively on both sides of the lower punching tool. Workpieces to be processed are moved for processing purposes relative to the punching station over the workpiece support. In this context, a coordinate guide of the punching machine takes over the workpiece movement in a first axis direction of the horizontal workpiece movement plane. In the second axis direction of the horizontal workpiece movement plane, the workpieces to be processed are moved by means of the workpiece support, which is guided in a movable manner for this purpose on the lower frame leg of the punching machine.

The loading and unloading device of the machine arrangement according to U.S. 2003/014 7729 A1 includes a frame, a platform capable of being raised and lowered on this frame in the vertical direction, and a gripper arranged above the platform and capable of being positioned in the horizontal direction.

After completion of the processing of a workpiece, the processing product produced is moved by means of the coordinate guide of the punching machine to the edge of one of the support parts of the workpiece table. The platform of the loading and unloading device is arranged laterally alongside the workpiece support of the punching machine in the vertical direction slightly below the workpiece support. With the processing product arranged on it, the workpiece support of the punching machine then travels from a starting position over the platform of the loading and unloading device. The gripper of the loading and unloading device is now advanced in the horizontal direction until it can grip the edge of the processing product supported by the workpiece support of the punching machine. When the processing product is fixed to the gripper of the loading and unloading device, the workpiece support of the punching machine travels back to its starting position. When doing so, the relevant support part of the workpiece support is withdrawn below the processing product and the processing product is deposited subject to the effect of gravity on the platform of the loading and unloading device disposed below it.

SUMMARY

One aspect of the invention features a machine arrangement for processing of panel-like work-pieces, especially metal sheets. The machine arrangement includes:

a processing station in which a workpiece can be processed, and accordingly, a processing product can be produced from the workpiece, a workpiece support for supporting the workpiece during the workpiece processing and for supporting the processing product after the workpiece processing, where the workpiece support comprises support parts arranged laterally side-by-side, one of which is provided as an unloading-side support part and another is provided as a further support part, and which, in the case of an arrangement at a common level, are substantially flush with one another in the horizontal direction at their upper side, a movement device provided for the workpiece and for the processing product, to which the workpiece and the processing product can be attached in a detachable manner, and by means of which the workpiece attached to the movement device and the processing product attached to the movement device can be moved over the work-piece support, and a handling device for the unloading of the processing product from the work-piece support.

Another aspect of the invention features a method for handling of a processing product, which has been produced in a processing station of a machine arrangement for the processing of panel-like workpieces, especially metal sheets, from a workpiece. The processing product is supported by a workpiece support which comprises support parts arranged laterally side-by-side, one of which is provided as an unloading-side support part and another is provided as a further support part, and which, when arranged at a common level are substantially flush with one another in the horizontal direction. The processing product is attached in a detachable manner to a movement device, to which the workpiece was also attached in a detachable manner, and the processing product attached to the movement device is moved by means of the movement device over the workpiece support. The processing product is unloaded from the workpiece support by means of a handling device.

In the case of the invention, a workpiece support with an unloading-side support part and a further support part is provided, where the unloading-side support part can be displaced in the vertical direction. When the two support parts are disposed at a common level, they are flush with one another and, in particular, a workpiece to be processed can be moved over the two support parts by means of the movement device of the machine arrangement for the purpose of processing. If a punching station is provided as a processing station of the machine arrangement and a coordinate guide is provided as movement device, the workpiece to be processed, for example, a metal sheet to be processed is positioned relative to the punching tool of the punching station in a known manner by means of the coordinate guide with movements in a horizontal plane. The workpiece to be processed and also the processing product produced as a result of the workpiece processing is fixed to the movement device. Finished parts or processing skeletons, and also processing skeletons with finished products held in it via micro-joints can be produced as processing products of a cutting, especially a punching sheet-metal processing.

After the completion of the workpiece processing and before the start of the unloading process, the processing product is stored on the further support part of the workpiece support. The unloading-side support part of the workpiece support is lowered in the vertical direction to an unloading level. When the unloading-side support part of the workpiece support is disposed at the unloading level, the handling device can take up an unloading position laterally alongside the further support part. In the unloading position, the handling device is arranged in the vertical direction so that a product support provided on the handling device for the processing product takes up a position relative to the further support part of the workpiece support, in which the processing product supported by the further support part and fixed to the movement device can be transferred by means of the movement device to the product support of the handling device.

In the case of the invention, there is, therefore, the possibility of moving the processing product fixed after the workpiece processing to the movement device of the machine arrangement by means of the movement device, without re-clamping, from the further support part of the workpiece support to the handling device. Consequently, the movement device can load the handling device with the processing product directly with the unloading of the workpiece support of the machine arrangement. Preferably, the product support forms the upper boundary of the handling device.

Particular embodiments of the invention are specified.

For the height adjustment of the unloading-side support part of the workpiece support, different options are available according to the invention. For example, a motorized actuation drive provided exclusively for this purpose is conceivable.

In some embodiments, the use of the handling device for the lowering of the unloading-side support part of the workpiece support to the unloading level is preferred according to the invention. In this context, pressure is preferably exerted by means of the handling device on the upper side of the unloading-side support part. Subject to the effect of this pressure, the unloading-side support part descends relative to the further support part, preferably starting from the common level, to the unloading level. Because of the multiple use according to the invention of the handling device, the height adjustment of the unloading-side support part can be achieved with a relatively small construction effort.

For corresponding reasons, in the case of the embodiment of the invention, a lowering of the unloading-side support part of the workpiece support against the action of a restoring force is provided. After the unloading of the workpiece support, the restoring force causes an automatic raising of the unloading-side support part from the unloading level to the starting level, in particular, to the common level, at which the two support parts of the workpiece support of the machine arrangement are flush with one another.

In the interests of a high functional reliability of the machine arrangement according to the invention and of the method according to the invention, in a further preferred embodiment of the invention, an unloading aid is provided, by means of which the processing product moved onto the product support of the handling device can be moved away from the movement device. In this manner, a functionally reliable separation of the processing product initially fixed to the movement de-vice from the movement device is ensured.

A compact construction of the overall arrangement is achieved if the unloading aid is provided on the handling device.

In a further embodiment of the invention, a fixing device is provided and serves to secure the processing product transferred to the handling device from an undesired displacement, in particular, from falling down. In particular, the securing function of the fixing device is significant because the processing product needs to be removed by means of the handling device from the proximity of the unloading-side support part of the workpiece support, before the unloading-side support part of the workpiece support can be re-raised to its starting level. For example, a clamping device comes into consideration as the fixing device. The clamping device can be a knee-lever apparatus or mechanism.

In the interests of a compact construction of the overall arrangement, in a preferred embodiment of the invention, the unloading aid by means of which the processing product is separated from the movement device, simultaneously forms the fixing device.

In a further embodiment of the invention, it is provided that the processing product received by the handling device is moved jointly with the handling device into a transfer position and, starting from the transfer position, is transferred by means of a transfer device to a product store, for example, to a corresponding pallet.

For the sake of simplicity, the transfer device in the case of the embodiment of the invention is a scraper device. By means of the scraper device, the processing product deposited on the product support of the handling device is scraped onto the product store, if applicable onto a product pallet. In order to generate a scraping movement, on the one hand, the handling device loaded with the processing product, and, on the other hand, the scraper device, perform a preferably horizontal relative movement.

In a further preferred embodiment of the invention, the handling device is arranged in the transfer position at a lower level than in the unloading position. The product store, which cooperates with the handling device moved into the transfer position, can accordingly be provided in a region of the machine arrangement in which it does not obstruct the handling device arranged in the unloading position.

In a further preferred embodiment of the invention, the handling device of the machine arrangement according to the invention is used not only for the unloading but also for the loading of the workpiece support. The unloading-side support part of the workpiece support simultaneously forms a loading-side support part. A workpiece to be processed, which is to be supplied to the workpiece support of the machine arrangement, is fixed on the handling device by means of a holding device in such a manner that the workpiece to be processed is arranged on the underside of the handling device remote from the product support. For the loading of the workpiece support, in particular, of the loading-side and unloading-side support part, the handling device is moved into a loading position, in which the handling device is disposed, in common with the workpiece to be transferred to the workpiece support, above the loading-side and unloading-side support part. The workpiece is transferred from the handling device arranged above the loading-side and unloading-side support part to the loading-side and unloading-side support part.

The transfer, completed at the underside of the handling device, of a workpiece to be processed, from the handling device to the loading-side and unloading-side support part, can be implemented at the same time as the transfer of a processing product from the further support part to the product support of the handling device, implemented on the opposite side of the handling device by means of the movement device. In this case, the loading-side and unloading-side support part of the workpiece support is lowered to the unloading level at the time of the loading with the workpiece to be processed.

In a preferred embodiment of the invention, the transfer of the workpiece to be processed to the workpiece support takes place only after the workpiece support has been unloaded and accordingly after the processing product to be removed from the work-piece support has been moved to the product support of the handling device. After the transfer of the processing product to the handling device, the latter is first raised, where the loading-side and unloading-side support part lowered at the time of the unloading of the workpiece support to the unloading level is preferably raised simultaneously with the lifting movement of the handling device to the common level, at which the loading-side and unloading-side support part is flush with the further support part of the workpiece support.

This procedure is recommended especially in cases in which a movement device is provided, as movement device for the workpiece and the processing product, which is disposed, for example, like a conventional coordinate guide, at a level associated with the common level of the support parts of the workpiece support. If the arrangement of the movement device is matched to the common level of the loading-side and unloading-side support part and of the further support part of the workpiece support, the workpiece to be transferred from the handling device to the loading-side and unloading-side support part is disposed below the movement device when the workpiece support is unloaded.

With such an embodiment of the machine arrangement according to the invention, if the handling device is raised, after the unloading of the workpiece support together with the workpiece held in a detachable manner on the handling device, into a loading position at a corresponding level, the workpiece to be processed can be transferred from the handling device directly to the movement device, that is, without preceding detachment from the handling device and without preceding storage on the loading-side and unloading-side support part. The workpiece to be processed is only released from the handling device after it has been attached to the movement device. At the latest at this time, the loading-side and unloading-side support part of the workpiece support should be raised to the common level. Immediately after the detachment from the handling device, the workpiece can then be moved over the workpiece support by means of the movement device in the manner required for the processing.

According to the invention, it is preferred to arrange the handling device such that the workpiece fixed to the handling device and arranged on the underside of the handling device can be moved towards the movement device with a horizontal transfer movement.

This guarantees a functionally reliable transfer of the workpiece to be processed, which can be achieved with a kinematically simple workpiece movement from the handling device to the movement device.

The transfer of the workpiece to be processed to the movement device can be implemented exclusively through a corresponding movement of the handling device. In this case, if the workpiece holding device of the handling device allows movements of the workpiece held on the handling device in the workpiece plane, the workpiece fixed to the handling device can be aligned relative to the movement device in the workpiece plane in such a manner that a reliable transfer of the workpiece by the movement device is guaranteed.

By way of further development of the invention, a loading aid serving for the active workpiece transfer is provided, where it is conceivable for the handling device and the loading aid each to take over one part of the workpiece transfer to the movement device. In the interests of a compact construction of the overall arrangement, the loading aid can be provided in the handling device.

In a further embodiment of the invention, the handling device is capable of receiving on a workpiece store a workpiece to be processed, which is to be supplied to the workpiece support. For this purpose, the handling device can be moved into a receiving position on the workpiece store. By means of the workpiece holding device of the handling device, the workpiece received from the workpiece store is attached in a detachable manner to the handling device with arrangement on the underside of the latter.

In one embodiment, the handling device can both transfer a processing product stored on the product support of the handling device to a product store for processing products and also receive a workpiece to be processed from a workpiece store for workpieces to be processed. For the transfer of a processing product to the product store, the handling device can be moved into the transfer position, and, in order to receive a workpiece to be processed from the workpiece store, the handling device can be moved into the receiving position. If the transfer position of the handling device is arranged above the receiving position of the handling device, the machine arrangement can be characterized by a relatively small footprint.

Various implementations of the devices, methods, and systems of the invention can simplify unloading of processing products in a machine arrangement of the type recited in the introduction. It is achieved by the machine arrangement and the method for handling a processing product.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
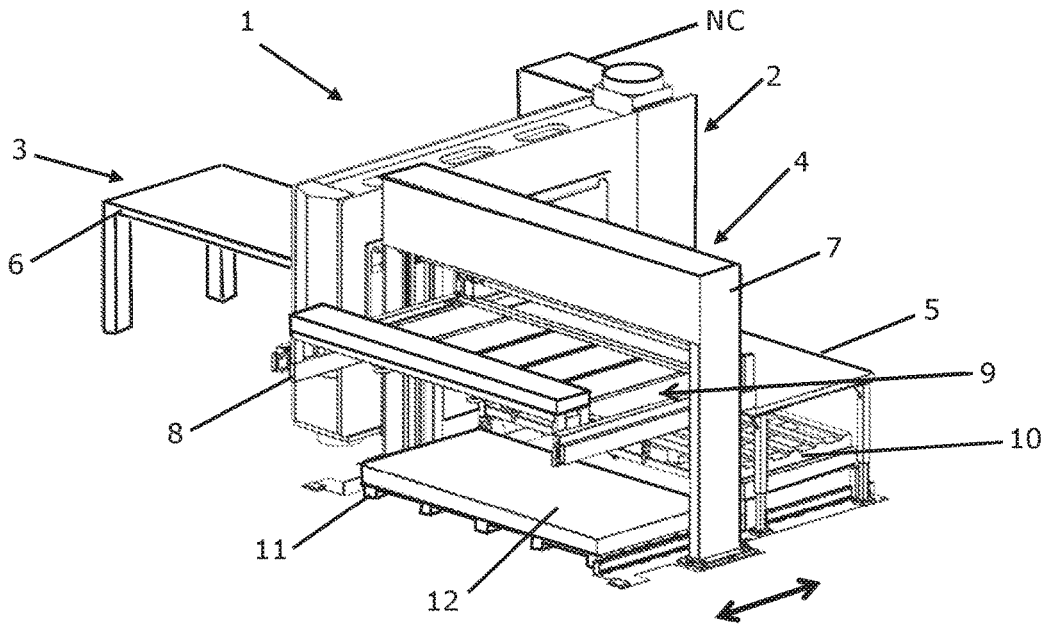
FIG. 1 shows an example machine arrangement for punching sheet-metal processing.

According to FIG. 1, a machine arrangement 1 for the punching processing of metal sheets comprises, as the processing station, a punching machine 2 with a workpiece support 3 and a loading and unloading device 4. The workpiece support 3 comprises two support parts, in detail, a height-adjustable loading-side and unloading-side support part 5 and, arranged laterally alongside thereof, a further support part 6. The loading and unloading device 4 comprises a portal-like bearing structure 7, a guide frame 8 movable in the vertical direction on the portal-like bearing structure 7 and a handling device in the form of a sucker frame 9 movable in the horizontal direction (double arrow in FIG. 1) on the guide frame 8.

Below the loading-side and unloading-side support part 5 in FIG. 1, a product store in the form of a processing-skeleton pallet 10 is shown. The processing-skeleton pallet 10 is raised relative to a blank-sheet pallet 11. The blank-sheet pallet 11 forms a workpiece store and stores a stack of blanks 12 which are to be supplied to the punching ma-chine 2 as workpieces to be processed. While the blank-sheet pallet 11 rests stationary on the standing area of the machine arrangement 1, the processing skeleton pallet 10 can travel in the horizontal direction between the position according to FIG. 1 and a position above the blank-sheet pallet 11 (double arrow in FIG. 1). All of the processes in the machine arrangement 1 are controlled by a programmable numerical machine control NC indicated in FIG. 1.

Figure 2:
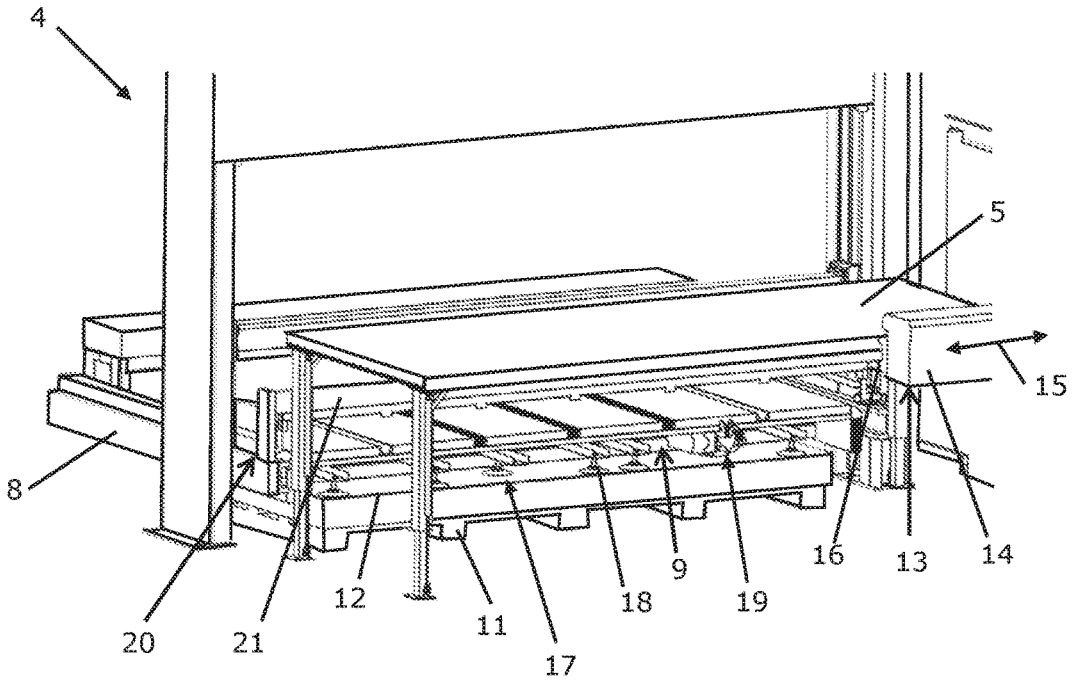
FIGS. 2 to 10 are drawings illustrating processes during loading and unloading of a workpiece support.

FIG. 1 shows the machine arrangement 1 at a time at which a blank 12 supported on the workpiece support 3 and covered in FIG. 1 by the punching machine 2 and the portal-like bearing structure 7 of the loading and unloading device 4 is processed by punching in the punching machine 2. The loading-side and unloading-side support part 5 and the further support part 6 are arranged at a common level and are accordingly flush with one another in the horizontal direction. The blank 12 to be processed is moved for processing purposes over the workpiece support 3 and, in this context, over both the loading-side and unloading-side support part 5 and also the further support part 6. With the movements executed, the blank 12 is positioned in the required manner relative to the punching tool of the punching machine 2. In order to generate the movement of the metal sheet 12 over the workpiece support 3, a movement device is used, which is embodied as a conventional coordinate guide 13. In FIG. 2, the coordinate guide 13 is shown with a transverse beam 14 and a transverse rail 16 guided in a movable manner in the direction of a double arrow 15 on the transverse beam 14.

Further, FIG. 2 shows the loading and unloading device 4 in an operational state in which the guide frame 8 with the sucker frame 9 is lowered by comparison with the position according to FIG. 1. The sucker frame 9 in FIG. 2 is disposed in a receiving position. A sucker field 17 provided as a workpiece holding device of the sucker frame 9, which comprises a plurality of vacuum suckers 18, is seated on the blank 12 disposed uppermost on the sheet stack stored on the sheet-metal pallet 11. The vacuum suckers 18 of the sucker field 17 are activated, and the blank 12 being in contact with the vacuum suckers 18 is consequently attached to the sucker frame 9.

FIG. 2 also shows a knee-lever arrangement 19 mounted to the sucker frame 9 and a scraper device 20, which forms a transfer device and comprises a scraper 21 which is guided movably in the vertical direction on the guide frame 8 of the loading and un-loading device 4. In FIG. 2, the scraper 21 is in its upper end position. For reasons of clarity, FIG. 2 does not show the processing-skeleton pallet 10 arranged below the loading-side and unloading-side support part 5.

Starting from the conditions according to FIG. 2, the guide frame 8 of the loading and unloading device 4 together with the sucker frame 9 and the blank 12 attached thereto is raised until the blank 12 fixed to the sucker frame 9 is arranged slightly above the loading-side and unloading-side support part 5. Subsequently, the sucker frame 9, together with the blank 12 attached thereto, travels in the horizontal direction over the loading-side and unloading-side support part 5.

Figure 3:
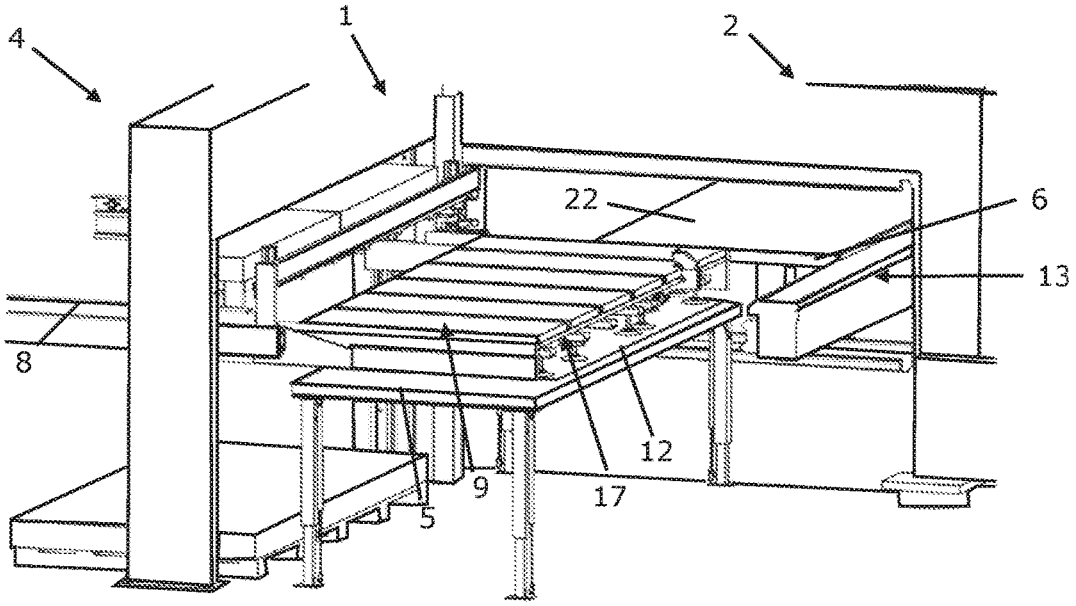

As soon as the current sheet-metal processing in the punching machine 2 is completed, a processing-skeleton 22 produced as the result of the sheet-metal processing and present as the processing product is positioned by means of the coordinate guide 13 on the workpiece support 3 in such a manner that it is disposed exclusively on the further support part 6. This leads to the operational state of the machine arrangement 1 illustrated in FIG. 3. In FIG. 3 and the subsequent FIGS. 4 to 9, the processing-skeleton 22 is illustrated only extremely schematically and accordingly without the punchings produced during the preceding workpiece processing. In FIG. 10, the processing-skeleton 22 is illustrated with the punchings.

Figure 4:
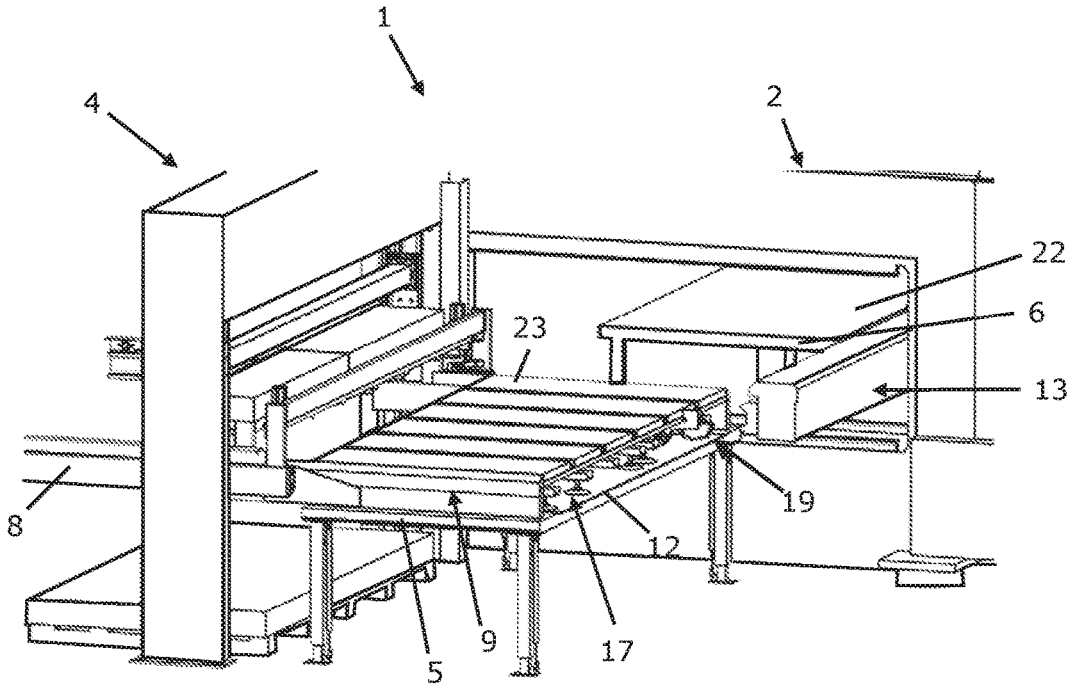

When the processing-skeleton 22 is disposed completely on the further support part 6, the sucker frame 9, together with the blank 12 attached thereto, is lowered through a corresponding movement of the guide frame 8 from the position according to FIG. 3. In this context, the sucker frame 9 applies pressure to the loading-side and unloading-side support part 5, in consequence of which the loading-side and unloading-side support part 5 is lowered against the action of a restoring force. Consequently, the loading-side and unloading-side support part 5 travels from the level shared with the further support part 6 shown in FIG. 3 to an unloading level (FIG. 4). The magnitude of the lowering movement of the loading-side and unloading-side support part 5 is dimensioned so that the sucker frame 9, with the loading-side and unloading-side sup-port part 5 disposed at the unloading level, is flush in the horizontal direction, at a product support 23 formed on the upper side of the sucker frame 9, with the further support part 6. An arrangement of the product support 23 of the sucker frame 9 slightly below the non-height-adjustable further support part 6 is also conceivable. The sucker frame 9 is now disposed in the unloading position. The knee-lever arrangement 19 on the sucker frame 9 is switched, by means of a pneumatic drive provided for this purpose, into the inoperative state in which the knee-lever arrangement 19 releases the product support 23 of the sucker frame 9.

Figure 5:
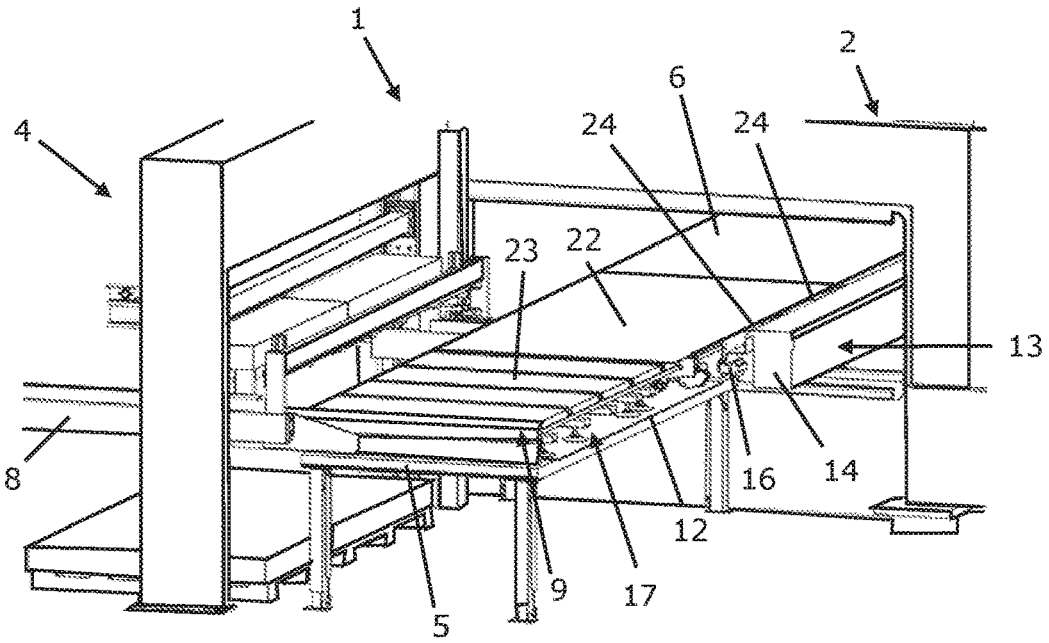

When the sucker frame 9 assumes the unloading position above the loading-side and unloading-side support part 5 lowered to the unloading level, the processing-skeleton 22 disposed initially on the further support part 6 is moved by means of the coordinate guide 13 onto the product support 23 of the sucker frame 9 (FIG. 5). For this purpose, the transverse rail 16 of the coordinate guide 13 travels along the transverse beam 14. The processing-skeleton 22 is fixed in a detachable manner to the transverse rail 16 by means of conventional clamping claws 24. As soon as the processing-skeleton 22 has been completely transferred to the product support 23 of the sucker frame 9 disposed in the unloading position (FIG. 6), the knee-lever arrangement 19 mounted to the sucker frame 9 is activated in the manner shown in FIGS. 7 and 8.

Figure 7:
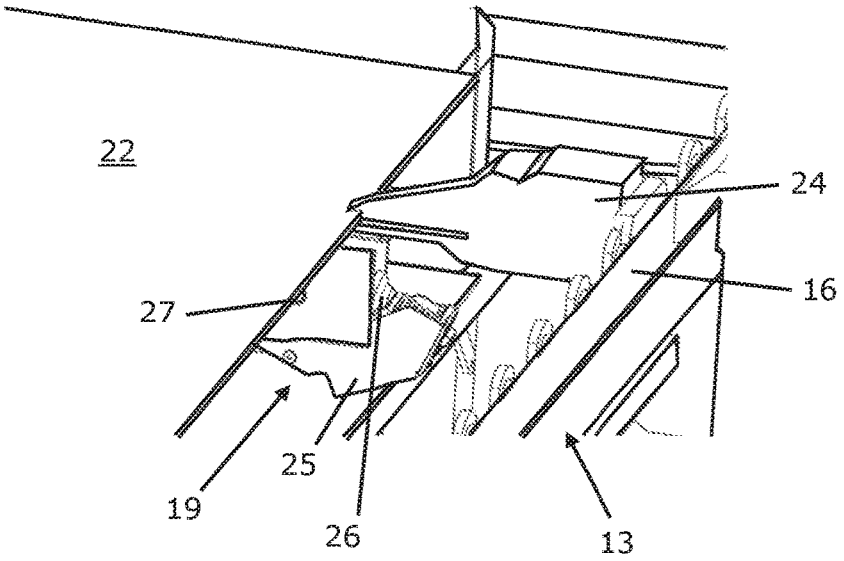
Figure 8:
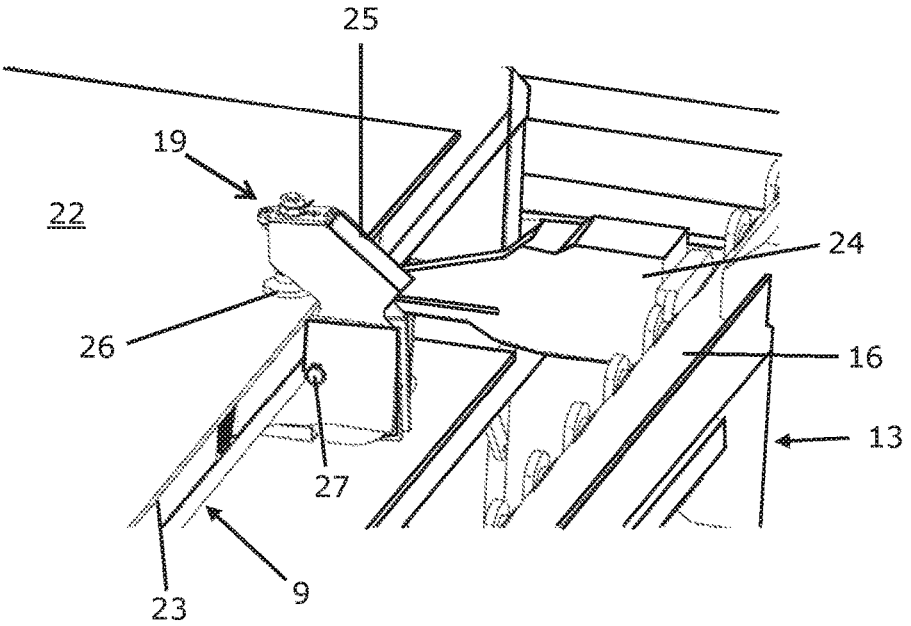

FIG. 7 shows the knee-lever arrangement 19 at the time at which the processing-skeleton 22 is transferred, by means of the coordinate guide 13, completely to the product support 23 of the sucker frame 9 moved into the unloading position, and the clamping claws 24 on the transverse rail 16 of the coordinate guide 13 still clamp the processing-skeleton 22. A clamping arm 25 of the knee-lever arrangement 19 being a knee-lever clamp is pivoted, together with a compression element 26 mounted thereto, into a position in which it does not obstruct the transfer of the processing-skeleton 22 to the product support 23 of the sucker frame 9.

Starting from these conditions, the clamping claws 24 of the coordinate guide 13 are opened and the clamping of the processing-skeleton 22 achieved by means of the clamping claws 24 is released. A pneumatic piston-cylinder drive of the knee-lever arrangement 19, which is disposed in a concealed manner in the drawings, is now activated, and the clamping arm 25 pivots, starting from its position according to FIG. 7, in an anticlockwise direction about a pivoting axis 27 of the knee-lever arrangement 19. In this context, the clamping arm 25 stops against the edge of the processing-skeleton 22 facing towards it before it takes the processing-skeleton 22 with it in its continuing pivoting movement, and therefore towards the left in the drawings, and accordingly away from the coordinate guide 13. When the clamping arm 25 reaches its end position (FIG. 8), the processing-skeleton 22 is released from the clamping claws 24 of the coordinate guide 13 and the clamping arm 25 applies a clamping force to the processing skeleton 22 via the compression element 26, due to which clamping force the processing skeleton 22 is immovably held on the product support 23 of the sucker frame 9. In the illustrated end position, the clamping arm 25 remains by itself. Consequently, the desired fixing of the processing-skeleton 22 on the sucker frame 9 is guar-anteed, even in the case of a failure of the compressed air supply of the pneumatic drive of the knee-lever arrangement 19.

Figure 6:
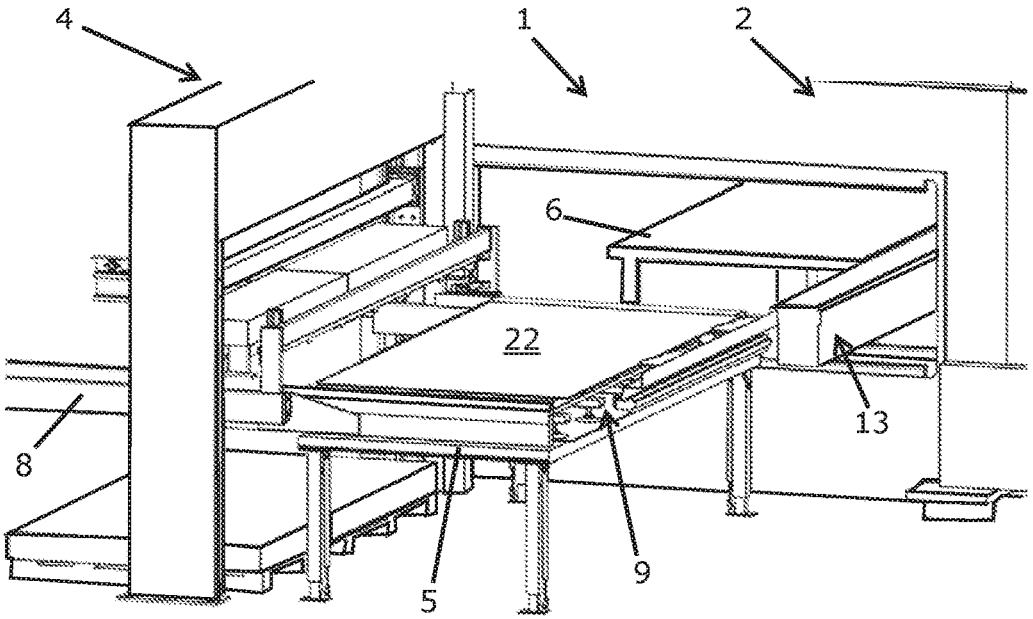
Figure 9:
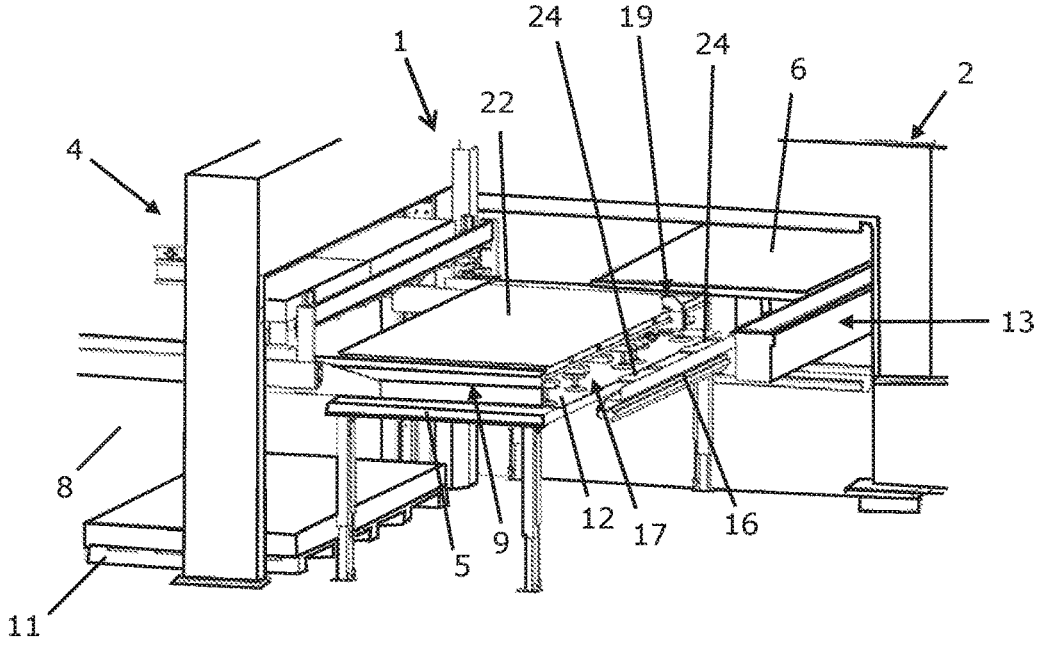
Figure 10:
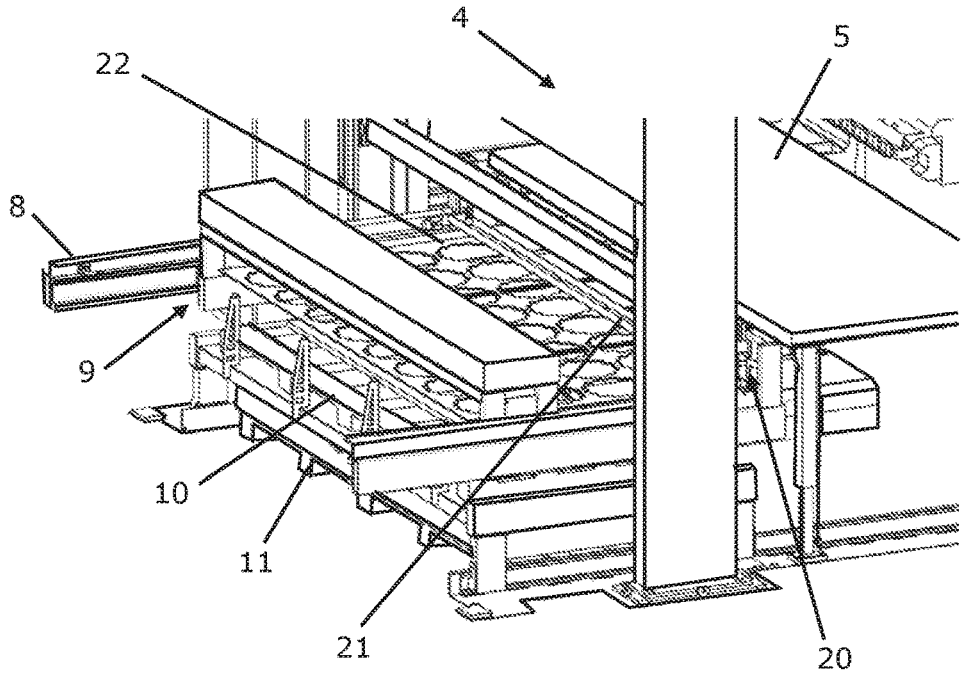

The sucker frame 9 is now raised by means of the guide frame 8 from the unloading position according to FIGS. 4 to 6 into the loading position according to FIG. 9.

When the sucker frame 9 is disposed in the loading position, the blank 12 attached to the underside of the sucker frame 9 is disposed at the height of the still open clamping claws 24 of the coordinate guide 13. In this context, the blank 12 is disposed on the sucker frame 9 in a floating manner in the sheet-metal plane.

The blank 22 can now be transferred with a horizontal transfer movement to the coordinate guide 13.

In the illustrated exemplary case, the horizontal transfer movement of the blank 12 is performed by means of the sucker frame 9. The sucker frame 9 travels, with the blank 12 attached thereto, horizontally in the direction towards the coordinate guide 13.

In this context, the blank 12 enters the open clamping claws 24 of the coordinate guide 13 until it comes into contact with depth stops of the clamping claws 24. This concludes the horizontal positioning movement of the sucker frame 9. The clamping claws 24 are closed and the blank 12 is attached to the coordinate guide 13.

If the blank 12 attached to the sucker frame 9 is aligned with its edge facing towards the coordinate guide 13 not exactly parallel to the transverse rail 16 and therefore not exactly parallel to the imaginary connecting line of the depth stops provided in the clamping claws 24 extending along the transverse rail 16, the blank 12 initially stops, in the movement performed by means of the sucker frame 9 in the direction towards the coordinate guide 13, only against the depth stop of one of the clamping claws 24.

However, since the blank 12 is disposed by means of the sucker field 17 in a floating manner on the sucker frame 9 in the sheet-metal plane, the sucker frame 9 can continue its movement in the direction towards the coordinate guide 13 after the stopping of the blank 12 against the depth stop of one of the clamping claws 24, until the blank 12 has also come up against the depth stops of the other clamping claws 24, and the blank 12 consequently extends with its edge facing towards the coordinate guide 13 exactly parallel to the transverse rail 16 and is reliably attached to the coordinate guide 13 when the clamping claws 24 are closed.

The floating support of the blank 12 by the sucker frame 9 can be achieved, for example, by means of vacuum suckers 18 which are so-called rotation-point vacuum suckers and, as such, are flexible in the sheet-metal plane of the blank 12. If the sucker field 17 comprises vacuum suckers 18 that are rigid in the sheet-metal plane in addition to such rotation-point vacuum suckers, it is ensured, through corresponding control of the sucker field 17, that the blank 12 is held on the sucker frame 9 during its transfer to the clamping claws 24 of the coordinate guide 13 only by means of the rotation-point vacuum suckers.

With the lifting movement of the sucker frame 9 from the unloading position into the loading position, the loading-side and unloading-side support part 5 has moved automatically, subject to the action of the restoring force, which has been built up in the lowering of the loading-side and unloading-side support part 5 from the common level to the unloading level, back to the common level, at which the loading-side and un-loading-side support part 5 is flush in the horizontal direction with the further support part 6 of the workpiece support 3. Consequently, as soon it is fixed on the coordinate guide 13, and the sucker field 17 of the sucker frame 9 has been completely deactivated, the blank 12 can be moved, by means of the coordinate guide 13, starting from the loading-side and unloading-side support part 5, over the entire workpiece support 3 for processing purposes.

After the transfer of the blank 12 to the workpiece support 3 of the punching machine 2, the sucker frame 9 with the processing-skeleton 22 deposited on the product support 23 of the vacuum frame 9 is moved, starting from the position according to FIG. 9, in the horizontal direction along the guide frame 8 into a position above the sheet-metal pallet 11. In this context, the processing skeleton 22 is secured on the sucker frame 9 by means of the knee-lever arrangement 19 from an undesired displacement and, in this context, especially from falling down. The knee-lever arrangement 19 is accordingly used not only as an unloading aid in the transfer of the processing-skeleton 22 from the coordinate guide 13 but also, additionally, as a fixing device.

Starting from the position disposed at the level of the loading position above the blank-sheet pallet 11, the sucker frame 9, together with the processing skeleton 22, is moved into a transfer position, in which the sucker frame 9 is shown in FIG. 10. Before, after or concurrently with the movement of the sucker frame 9 from the loading position according to FIG. 9 into the transfer position according to FIG. 10, the processing-skeleton pal-let 10 not illustrated in FIGS. 2 to 6 and 9 travels from the position below the loading-side and unloading-side support part 5 (FIG. 1) in the horizontal direction to the position according to FIG. 10, in which the processing-skeleton pallet 10 is arranged above the blank-sheet pallet 11 and the stack of blanks stored thereon.

When the processing-skeleton pallet 10 has travelled above the blank-sheet pallet 11, and the sucker frame 9 with the processing-skeleton 22 stored on it has travelled into the transfer position above the processing-skeleton pallet 10, that is, when the operating state according to FIG. 10 has been reached, the knee-lever arrangement 19 is switched into the inoperative state (FIG. 7), and the scraper device on the guide frame 8 is activated. The scraper 21 on the guide frame 8 is lowered from the upper end-position according to FIG. 2 until it comes to be disposed in the vertical direction at the height of the edge of the processing-skeleton 22 facing it. The sucker frame 9 now travels on the guide frame 8 in the horizontal direction below the loading-side and un-loading-side support part 5. Because of the associated movement of the sucker frame 9 relative to the scraper 21, the processing-skeleton 22 is scraped from the product sup-port 23 of the sucker frame 9 and moved subject to the effect of gravity from the product support 23 of the sucker frame 9 onto the processing-skeleton pallet 10.

When the processing-skeleton 22 has been transferred to the processing-skeleton pal-let 10, the processing-skeleton pallet 10 travels, together with the previously received processing-skeleton 22, back to the starting position according to FIG. 1. Furthermore, the sucker frame 9, with the now, once again empty product support 23, is moved back to a position above the blank-sheet pallet 11. Subsequently, the sucker frame 9 is lowered to the blank-sheet pallet 11 until the sucker field 17 on the underside of the sucker frame 9 contacts the blank 12 disposed uppermost in the sheet stack on the blank-sheet pallet 11. Through activation of the sucker field 17, the blank 12 impinged upon by the latter is attached to the sucker frame 9, and a further loading and unloading operation can take place in the manner described above.

A number of embodiments of the invention have been described. Nevertheless, it will be understood that various modifications may be made without departing from the spirit and scope of the invention. Accordingly, other embodiments are within the scope of the following claims.

What is claimed is:

1. A machine arrangement for processing panel-like workpieces, comprising:

a processing station for processing a workpiece to produce a processing product;

a workpiece support for supporting the workpiece during the workpiece processing and the processing product after the workpiece processing, wherein the workpiece support comprises an unloading-side support part and a further support part that are arranged laterally side-by-side and, when arranged at a common level, are substantially flush with one another in a horizontal direction;

a movement device to which the workpiece and the processing product can be attached in a detachable manner and by which the workpiece attached to the movement device and the processing product attached to the movement device can be moved over the workpiece support; and a handling device for unloading the processing product from the workpiece support, wherein the unloading-side support part and the further support part of the work-piece support are configured to support the workpiece during the workpiece processing, and wherein the workpiece is movable by the movement device over the unloading-side support part and the further support part for the workpiece processing, wherein the unloading-side support part of the workpiece support is height-adjustable and configured to be lowered in a vertical direction, by comparison with the common level and relative to the further support part, to an unloading level through height adjustment, wherein, for the unloading of the processing product from the workpiece support, the handling device is configured to be moved into an unloading position, in which the handling device engages over the unloading-side support part lowered to the unloading level, and wherein the handling device comprises a product support for the processing product, which, with the handling device moved into the unloading position, is arranged laterally alongside the further support part and in the vertical direction relative to the further support part, such that the processing product supported by the further support part can be moved by the movement device onto the product support of the handling device.

2. The machine arrangement of claim 1, wherein the unloading-side support part of the workpiece support is configured to be lowered to the unloading level by the handling device.

3. The machine arrangement of claim 1, wherein the unloading-side support part of the workpiece support is configured to be lowered to the unloading level against an action of a restoring force.

4. The machine arrangement of claim 1, further comprising an unloading aid by which the processing product moved onto the product support of the handling device can be moved away from the movement device.

5. The machine arrangement of claim 4, wherein the unloading aid is provided on the handling device.

6. The machine arrangement of claim 1, further comprising a fixing device by which the processing product moved onto the product support of the handling device can be fixed to the handling device.

7. The machine arrangement of claim 1, wherein the handling device and the processing product arranged on the product support are configured to be jointly moved into a transfer position, and wherein the machine arrangement further comprises a transfer device, by which, starting from the transfer position of the handling device, the processing product can be transferred from the product support of the handling device to a product store.

8. The machine arrangement of claim 7, wherein the transfer device comprises a scraper device by which the processing product is scrapable from the product support of the handling device onto the product store.

9. The machine arrangement of claim 7, wherein the transfer position of the handling device is arranged below the unloading position of the handling device.

10. The machine arrangement of claim 1, wherein the handling device is constituted as a loading and unloading device, and the unloading-side support part of the workpiece support is provided at the same time as a loading-side support part and accordingly as a loading-side and unloading-side support part of the workpiece support, wherein the handling device comprises a workpiece holding device, by which a workpiece to be processed can be attached in a detachable manner to the handling device, such that the workpiece attached by the workpiece holding device to the handling device is arranged on a lower side of the handling device remote from the product support of the handling device, wherein, for the loading of the loading-side and unloading-side support part, the handling device and the workpiece arranged on the lower side of the handling device can jointly be moved into a loading position, in which the handling device with the workpiece engages over the loading-side and unloading-side support part, and wherein the workpiece can be moved from the handling device moved into the loading position onto the loading-side and unloading-side support part.

11. The machine arrangement of claim 10, wherein the handling device is arranged in the loading position such that the workpiece attached to the handling device and arranged on the lower side of the handling device can be transferred to the movement device with a horizontal transfer movement.

12. The machine arrangement of claim 10, wherein the workpiece holding device of the handling device permits movements in a workpiece plane of the workpiece attached to the handling device by the workpiece holding device.

13. The machine arrangement of claim 12, wherein the movements of the workpiece attached to the handling device are permitted by the workpiece holding device against an action of a restoring force.

14. The machine arrangement of claim 10, further comprising a loading aid, by which the workpiece can be transferred from the handling device moved into the loading position to the movement device.

15. The machine arrangement of claim 10, wherein a workpiece store for at least one workpiece to be processed is provided, and the handling device can be moved into a receiving position, in which a workpiece to be processed can be received by the handling device from the workpiece store, by attaching the workpiece to the handling device in a detachable manner by the workpiece holding device of the handling device.

16. The machine arrangement of claim 15, wherein the receiving position of the handling device is arranged below the transfer position of the handling device.

* * * * *